United States Patent [19]

Hiltz

[11] Patent Number: 4,506,451

[45] Date of Patent: Mar. 26, 1985

[54] MULTI-FUNCTIONAL SQUARE AND ANGLE MARKING TOOL HAVING EXTENDABLE STOPS

[76] Inventor: Paul J. Hiltz, 61 Barnstable St., Hull, Mass. 02045

[21] Appl. No.: 552,990

[22] Filed: Nov. 17, 1983

[51] Int. Cl.[3] ..... B43L 7/00

[52] U.S. Cl. ..... 33/451; 33/429; 33/437

[58] Field of Search ..... 33/451, 415, 416, 403, 33/429, 437, 430, 474, 475, 479, 482

[56] References Cited

U.S. PATENT DOCUMENTS 934,260 9/1909 Allison ..... 33/403

2,098,616 11/1937 Cutting ..... 33/437

2,495,645 1/1950 Schultes et al. ..... 33/451

3,456,353 7/1969 Iams ..... 33/429

*Primary Examiner*—Willis Little

*Attorney, Agent, or Firm*—John M. Brandt

[57] ABSTRACT

A multi-functional tool arranged to allow rapid marking of perpendicular and angular lines on material surfaces is disclosed. One or more extendable stops are provided in the body of the tool to rapidly fix the angular orientation of a marking edge. Optionally, associated measuring devices such as a level, tape measure, and plumb bob, may be included to facilitate the location and orientation of the position to be marked.

7 Claims, 4 Drawing Figures

MULTI-FUNCTIONAL SQUARE AND ANGLE MARKING TOOL HAVING EXTENDABLE STOPS

BACKGROUND OF THE INVENTION

1. Field of the Invention

The invention resides in the field of multi-functional tools and more particularly relates to tools for measuring and laying out perpendicular and angular lines of material surfaces.

2. Description of the Prior Art

The prior art is replete with multi-functional tool devices arranged to mark off square and angular lines of material surfaces.

As examples, U.S. Pat. Nos. 937,020, Brandt; 2,247,327, Brady; 2,399,303, Thomas; 3,522,657, Metrulis; and 4,144,650, Rawlings, all disclose tools with some form of adjustable protractor arm or bevel for setting a selected angle to be marked. Additionally, U.S. Pat. No. 3,364,581, Andrews, shows the well-known machinist's square with modifications which include a 45° surface.

In constract, the present invention employs a retractable stop to form one point of two, which are butted up against an edge of a work piece to fix the angular orientation of the tool.

The inventor knows of no prior art which anticipates the invention disclosed herein.

SUMMARY OF THE INVENTION

The invention may be summarized as a multi-functional tool for laying out and marking off perpendicular and angular lines on material surfaces. The devices consists of a body and a thicker handle portion, one edge of which has a flat surface from which the body extends. The body is essentially rectangular in shape, having two parallel edges and two parallel sides, all extending perpendicularly from the flat surface of the handle.

When the body is laid upon a work piece having a material surface to be marked, the flat surface may be butted against an edge of the work piece to allow perpendicular lines to be drawn to that edge by scribing against either of the parallel edges. One or more extendable stops are provided in the body along either edge at selected distances from the flat surface of the handle. When a stop is extended, one corner of the handle flat surface and the stop are butted against the work piece edge. An angular line to the work piece edge may then be marked off on the material surface, the orientation of which is determined by the distance of the stop from the handle flat surface.

A number of stops can be located at different positions along the body to provide different angular orientations of the body edge. Each stop is preferably arranged to extend through the body in both directions, so that the tool may be flipped over to provide additional marking angles. Means, such as detents, are provided to secure the stops in the extended or retracted positions.

Additional measuring devices may also be included in the device. For example, a retractable tape measure can be included in the handle. Indices may be provided on the body edges for small measurements. Bubble levels can be set into the body surface and the enitre tool can function as a plumb bob by tapering the far edge of the handle to a pyramidal point and providing a hole for tieing a string opposite the point in the body.

These and other feature of the invention will be more clearly defined by the description of the preferred embodiment and drawings which follow.

DESCRIPTION OF THE PREFERRED EMBODIMENT

Figure 1:
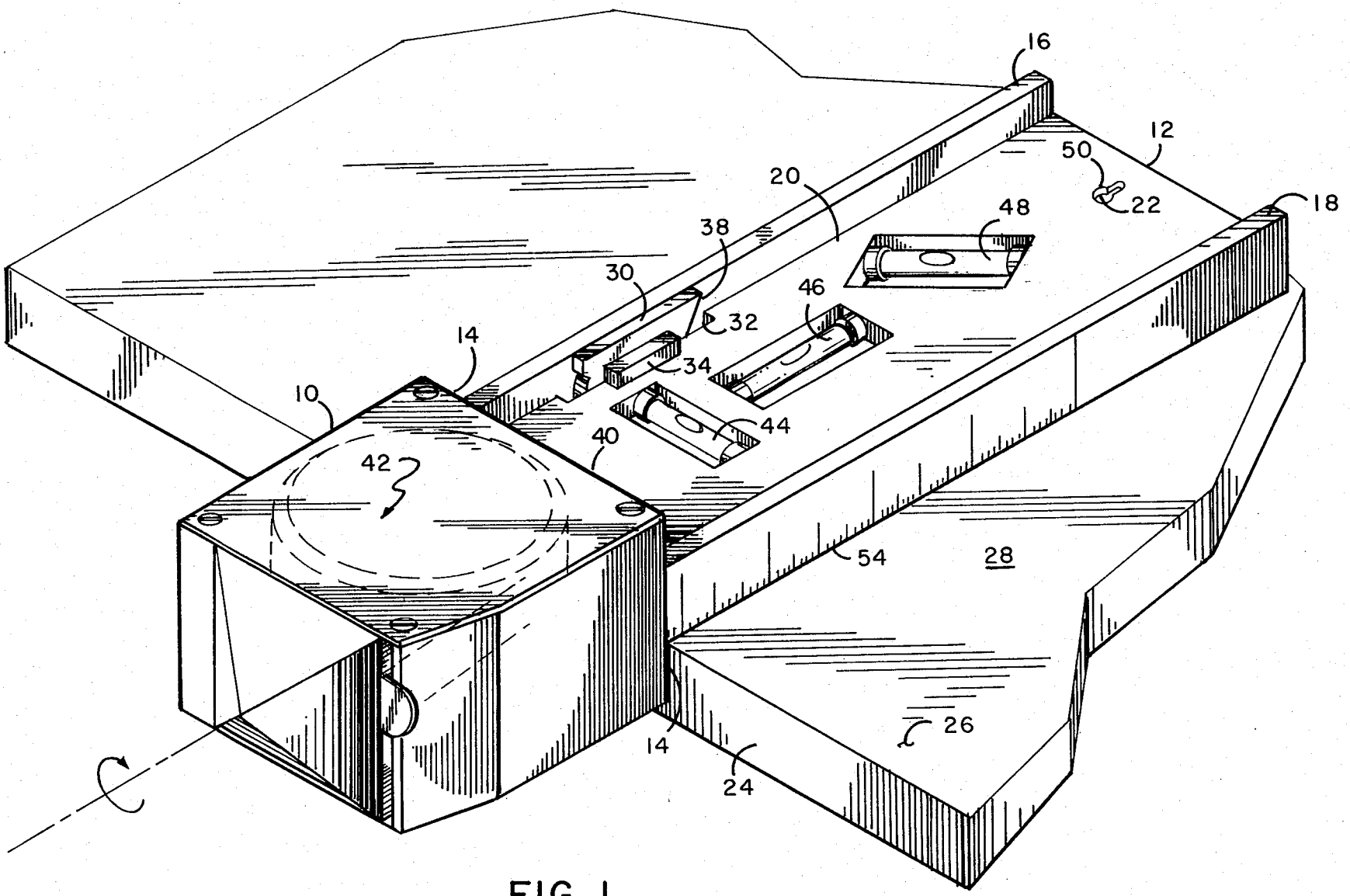
FIG. 1 is a perspective view of the preferred embodiment of the invention.

Referring to FIG. 1, there is illustrated a perspective view of the preferred embodiment of the invention in which handle 10 and body 12 comprise the basic structure of the multi-functional tool. The handle has flat surface 14 to which the thinner i-beam shaped body is centrally attached, parallel edges 16 and 18 and parallel surfaces 20 and 22 of the body extending perpendicularly from that surface. Surface 14 is show butted up against edge 24 of work piece 26, which permits perpendicular lines to be marked upon work piece surface 28 along edges 16 and 18.

Extendable stop 30 is disposed in slot 32 in body 12 and is pivotally mounted between edge 16 and block 34 attached to surface 20. Block 34 further contains a ball bearing and spring detent to hold stop 30 in the retracted position or in the extended position as shown in FIG. 2.

Figure 2:
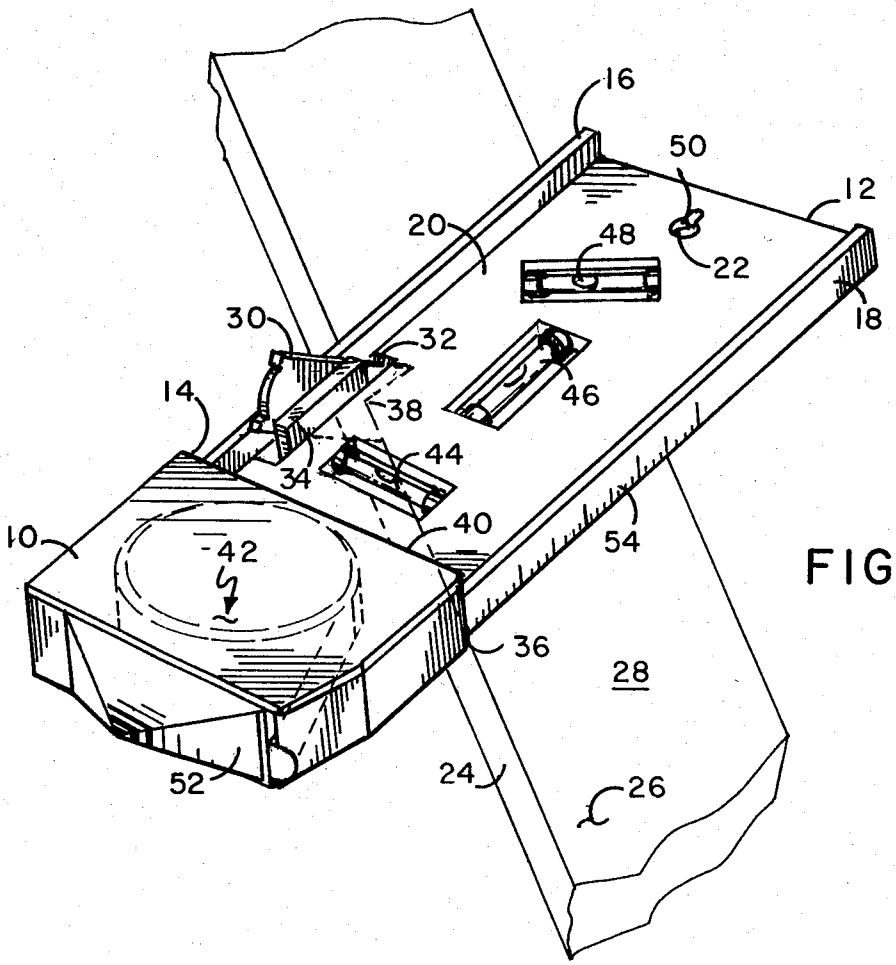
FIG. 2 is an additional perspective view of the embodiment of FIG. 1.

FIG. 2 illustrates the use of the tool to lay out non-perpendicular lines to edge 26. Stop 30 is extended downwardly to butt up against edge 24 in conjunction with corner 36 of handle 10. As is apparent, the angle obtained along edges 16 and 18 is dependant upon the distance of edge 38 of stop 30 from surface 14. A forty-five degree angle, which is most common in the building trades, will result by making that distance equivalent to the length of edge 40 of handle 10. Additional stops may be included to yield a multiplicity of angles, and, as the tool is reversible, may be located along either edge of the body.

Also illustrated in FIGS. 1 and 2 are additional measuring instruments which will facilitate the location and position of the lines to be marked on the work piece. In particular, a coilable, retractable tape measure 42 is shown disposed in handle 10, and bubble levels 44, 46 and 48 are positioned at various locations in body 12. Further, the entire tool may function as a plumb bob by tieing a string through hole 50 centrally located at the top of body 12, and providing a pyramidal-shaped end surface 52 on handle 10. Measuring indicia of various scales 54 may also be included on edges 16 and 18 if desired.

Figure 4:
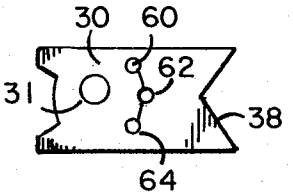
FIG. 4 is a plan view of one element of FIG. 1.
Figure 3:
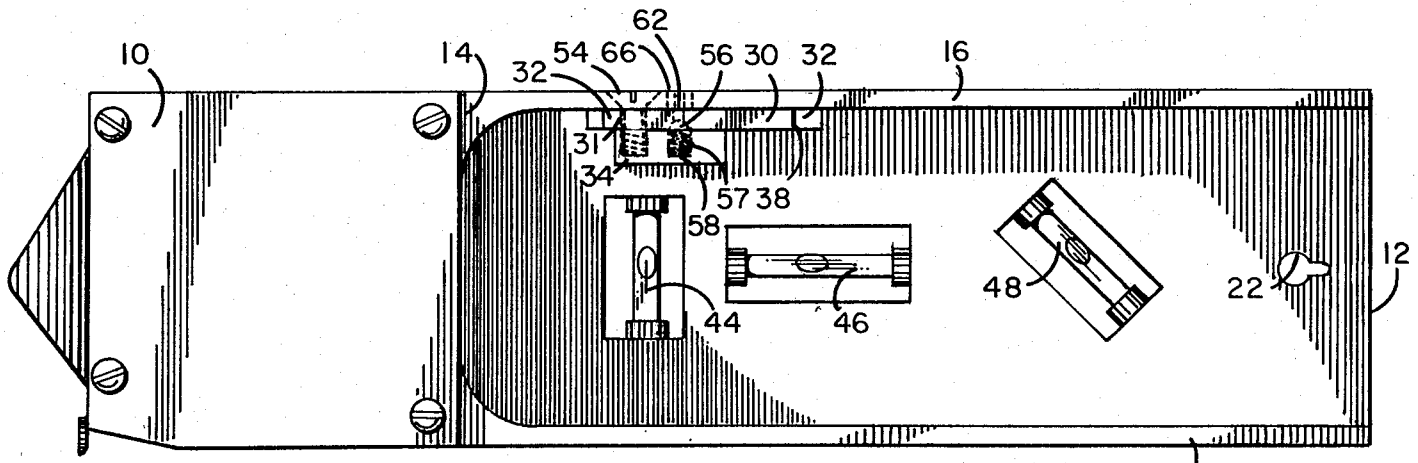
FIG. 3 is a plan view of the device of FIGS. 1 and 2.

Referring next to FIG. 3, a plan view of the invention is shown illustrating means for securing stop 30 in an extended or retracted position. Screw 54 secured to block 34 through edge 16 and hole 31 provides the pivot on which stop 30 rotates downward or upward. Ball detent 56 deposed in recess 57 in block 34 is biased outward by spring 58 and engages depressions 60, 62, or 64 in stop 30 shown in plan view in FIG. 4. Assembly of the detent is facilitated by the inclusion of hole 66 in edge 16. Further illustrated in FIG. 4 is the V profile of the forward edge of stop 30, which results in the upper or lower edge of the V meeting the work piece in flush relationship when the stop is extended upward of downward.

Additional configurations of the invention will become obvious in view of the above disclosure. Particularly, alternative stop devices can be employed to achieve the same results. Accordingly, the invention is defined by the following claims.

What is claimed is:

1. A multi-functional square and angle marking tool comprising in combination:

a. a handle having at least one flat surface;

b. a body portion thinner than said handle having two parallel edges and two parallel sides, said body portion attached to said handle substantially in the center of said flat surface such that said parallel sides and edges extend perpendicularly from said surface;

c. a stop extendably mounted through said parallel sides of said body portion a selected distance from said flat surface;

d. means for securing said stop in a retracted position whereby said stop is positioned not to extend beyond either of said sides; and e. means for securing said stop in an extended position whereby said stop is positioned to extend beyond either of said sides.

2. The apparatus of claim 1 wherein said stop comprises a plate pivotally mounted in said body, said plate having a V-shaped forward edge.

3. The apparatus of claim 2 wherein said plate is retained in the retracted and extended position by a ball detent assembly.

4. The apparatus of claim 1 further including a coilable tape measure disposed in said handle.

5. The apparatus of claim 1 further including at least one bubble level disposed in said body.

6. The apparatus of claim 1 wherein the surface of said handle opposite said flat surface is pyramidal in shape, and said body has a hole passing through said body surfaces opposite the apex of said pyramidal surface whereby said tool may form a blumb bob by tieing a string through said hole.

7. The apparatus of claim 1 further including scale indicia marked along at least one of said body edges.

* * * * *